US011047144B2

(12) United States Patent
Colino Vega

(10) Patent No.: US 11,047,144 B2
(45) Date of Patent: Jun. 29, 2021

(54) VERTICAL FORMWORK AND AN ANCHOR FOR A VERTICAL FORM WORK

(71) Applicant: ULMA C y E, S. Coop., Oñati (ES)

(72) Inventor: Manuel Colino Vega, Vitoria-Gasteiz (ES)

(73) Assignee: ULMA C Y E, S. COOP., Oñati (ES)

( * ) Notice: Subject to any disclaimer, the term of this patent is extended or adjusted under 35 U.S.C. 154(b) by 0 days.

(21) Appl. No.: 16/590,974

(22) Filed: Oct. 2, 2019

(65) Prior Publication Data

US 2020/0032531 A1 Jan. 30, 2020

Related U.S. Application Data

(63) Continuation of application No. PCT/ES2018/070258, filed on Mar. 27, 2018.

(30) Foreign Application Priority Data

Apr. 6, 2017 (EP) ..... 17382181

(51) Int. Cl.
*E04G 17/065* (2006.01)

(52) U.S. Cl.
CPC ..... *E04G 17/0652* (2013.01); *E04G 17/065* (2013.01); *E04G 17/0657* (2013.01)

(58) Field of Classification Search
CPC ... E04G 17/06; E04G 17/065; E04G 17/0651; E04G 17/0652; E04G 17/0654;
(Continued)

(56) References Cited

U.S. PATENT DOCUMENTS 1,850,402 A * 3/1932 Lampert ..... E04G 17/0742 249/219.1
1,935,218 A * 11/1933 Umbach ..... E04G 17/0658 249/190

(Continued)

FOREIGN PATENT DOCUMENTS

DE 102010002108 A1 8/2011
DE 102010003017 A1 9/2011

(Continued)

OTHER PUBLICATIONS

Extended European Search Report in corresponding European Patent Application No. 17382181.0, dated Sep. 7, 2017, 7 pages.

(Continued)

*Primary Examiner* — Michael Safavi
(74) *Attorney, Agent, or Firm* — Edell, Shapiro & Finnan, LLC

(57) ABSTRACT

According to one embodiment a rear anchor assembly for a vertical formwork is provided that includes a dome plate having a spherical-shaped central section. The dome plate has an opening that extends through the spherical-shaped central section. The rear anchor assembly also includes a nut with a threaded hole configured for housing a threaded end of a tie rod. The nut includes a spherical portion arranged in the opening of the dome plate. The spherical portion of the nut and the spherical-shaped central section of the dome plate are coupled like a ball and socket joint. The rear anchor assembly also includes a support plate configured for being fixed to a rear formwork panel, the support plate including a housing in which the dome plate is arranged, the dome plate having freedom of radial movement with respect to the support plate inside the housing.

20 Claims, 16 Drawing Sheets

(58) Field of Classification Search
CPC ..... E04G 17/0655; E04G 17/0657; E04G 17/0658; E04G 11/08; F16B 21/02; F16B 43/001
USPC ..... 249/40, 42, 43
See application file for complete search history.

(56) References Cited

U.S. PATENT DOCUMENTS 2,001,052 A * 5/1935 Colt ..... E04G 17/0742 249/217
2,002,526 A * 5/1935 Colt ..... E04G 17/0658 249/217
2,004,462 A * 6/1935 Bush ..... E04G 11/12 249/42
2,069,085 A * 1/1937 Day ..... E04G 17/0652 249/42
2,116,597 A * 5/1938 Colt ..... E04G 17/0658 249/217
2,162,869 A * 6/1939 Symons ..... E04G 17/0658 249/42
2,270,035 A * 1/1942 Colt ..... E04G 17/0658 249/42
2,281,833 A * 5/1942 De Canio ..... E04G 17/0658 249/217
2,491,460 A * 12/1949 Turzillo ..... E04G 17/0658 249/42
2,502,672 A * 4/1950 Roother ..... E04G 17/0657 249/217
2,523,131 A * 9/1950 Martin ..... E04G 11/10 249/42
2,659,125 A * 11/1953 Williams ..... E04G 17/0658 249/42
3,168,772 A * 2/1965 Williams ..... E04G 17/0652 249/42
3,198,476 A * 8/1965 Smith ..... E04G 17/0752 249/42
3,292,893 A * 12/1966 Williams ..... E04G 17/0658 249/42
3,415,484 A * 12/1968 Klaiss ..... E04G 17/0658 249/216
3,667,720 A * 6/1972 Williams ..... E04G 17/0658 249/213
3,910,546 A * 10/1975 Connors ..... E04G 17/0721 249/40
3,981,476 A * 9/1976 Alexander ..... E04G 17/0658 249/42
4,044,986 A * 8/1977 Strickland ..... E04G 17/0657 249/216
6,935,607 B2 * 8/2005 Ward ..... E04G 17/045 249/190
8,220,772 B2 * 7/2012 Schwoerer ..... E04G 17/0657 249/40
2004/0079860 A1 * 4/2004 Ward ..... E04G 17/045 249/33
2008/0173788 A1 * 7/2008 Brewka ..... E04G 11/10 249/189
2010/0059655 A1 3/2010 Schwoerer
2012/0304570 A1 * 12/2012 Braun ..... E04G 17/0657 52/426
2014/0374568 A1 * 12/2014 Amon ..... E04G 7/32 249/1
2015/0167329 A1 * 6/2015 Hagemes ..... E04G 11/08 52/745.21
2017/0002575 A1 * 1/2017 Dingier ..... E04G 17/14
2018/0320393 A1 * 11/2018 Dingier ..... E04G 17/0657

FOREIGN PATENT DOCUMENTS

DE 102012203678 A1 9/2013
EP 2126248 A1 12/2009
WO 2008089737 A1 7/2008
WO 2014012853 A1 1/2014

OTHER PUBLICATIONS

International Search Report and Written Opinion in corresponding International Patent Application No. PCT/ES2018/070258, dated Oct. 11, 2018, 9 pages.

* cited by examiner

VERTICAL FORMWORK AND AN ANCHOR FOR A VERTICAL FORM WORK

CROSS-REFERENCE TO RELATED APPLICATIONS

This application relates to and claims the benefit and priority to International Application No. PCT/ES2018/070258, filed Mar. 27, 2018, which relates to and claims the benefit and priority to European Application No. EP17382181.0, filed Apr. 6, 2017.

TECHNICAL FIELD

The present invention relates to an anchor for a vertical formwork and to a vertical formwork.

BACKGROUND

Vertical formworks are known to be used for building vertical structures, such as walls, for example. A vertical formwork comprises two formwork panels which are arranged facing and fixed to one another by means of a tie rod, the tie rod being fixed to the formwork panels by means of an anchor fixed to the respective formwork panel.

EP2126248A1 discloses a vertical formwork comprising a front formwork panel and a rear formwork panel which are arranged facing one another, a rear anchor fixed to the rear panel, a front anchor fixed to the front panel, and a tie rod fixed to the front anchor and to the rear anchor. The rear anchor comprises a dome plate fixed to the rear formwork panel, said dome plate comprising a spherical-shaped central section with an opening. The rear anchor also comprises a nut with a threaded hole configured for housing a threaded end of a tie rod, the nut comprising a spherical portion which is arranged in the opening of the dome plate.

DE102010003017A1 discloses a vertical formwork with a rear anchor with the features described above, wherein the spherical portion of the nut and the central section of the dome plate are coupled like a ball and socket joint, the rear anchor further comprising a support plate configured for being fixed to a rear formwork panel, said support plate comprising a housing in which the dome plate is arranged.

SUMMARY

A first aspect relates to a rear anchor for a vertical formwork. The rear anchor comprises a dome plate comprising a spherical-shaped central section comprising an opening. The rear anchor also comprises a nut with a threaded hole configured for housing a threaded end of a tie rod, the nut comprising a spherical portion which is arranged in the opening of the dome plate. The spherical portion of the nut and the central section of the dome plate are coupled like a ball and socket joint.

The rear anchor also comprises a support plate configured for being fixed to a rear formwork panel, said support plate comprising a housing in which the dome plate is arranged, and said dome plate having freedom of radial movement with respect to the support plate inside the housing.

A second aspect relates to a vertical formwork comprising a front formwork panel and a rear formwork panel which are arranged facing one another, a rear anchor with the features described above fixed to the rear panel, a front anchor fixed to the front panel, and a tie rod fixed to the front anchor and to the rear anchor.

The ball and socket joint-like coupling between the spherical portion of the nut and the central section of the dome plate, and the radial movement of the dome plate with respect to the support plate, allows orienting the nut with respect to the rear formwork panel. Therefore, when the operator has to screw the threaded end of a tie rod into the threaded hole of the nut, it can be done by adapting the orientation of the nut to the path of the tie rod. The rear anchor of the invention therefore provides an alternative configuration of a rear anchor for vertical formworks.

These and other advantages and features will become apparent in view of the drawings and detailed description.

DETAILED DESCRIPTION

Figure 1:
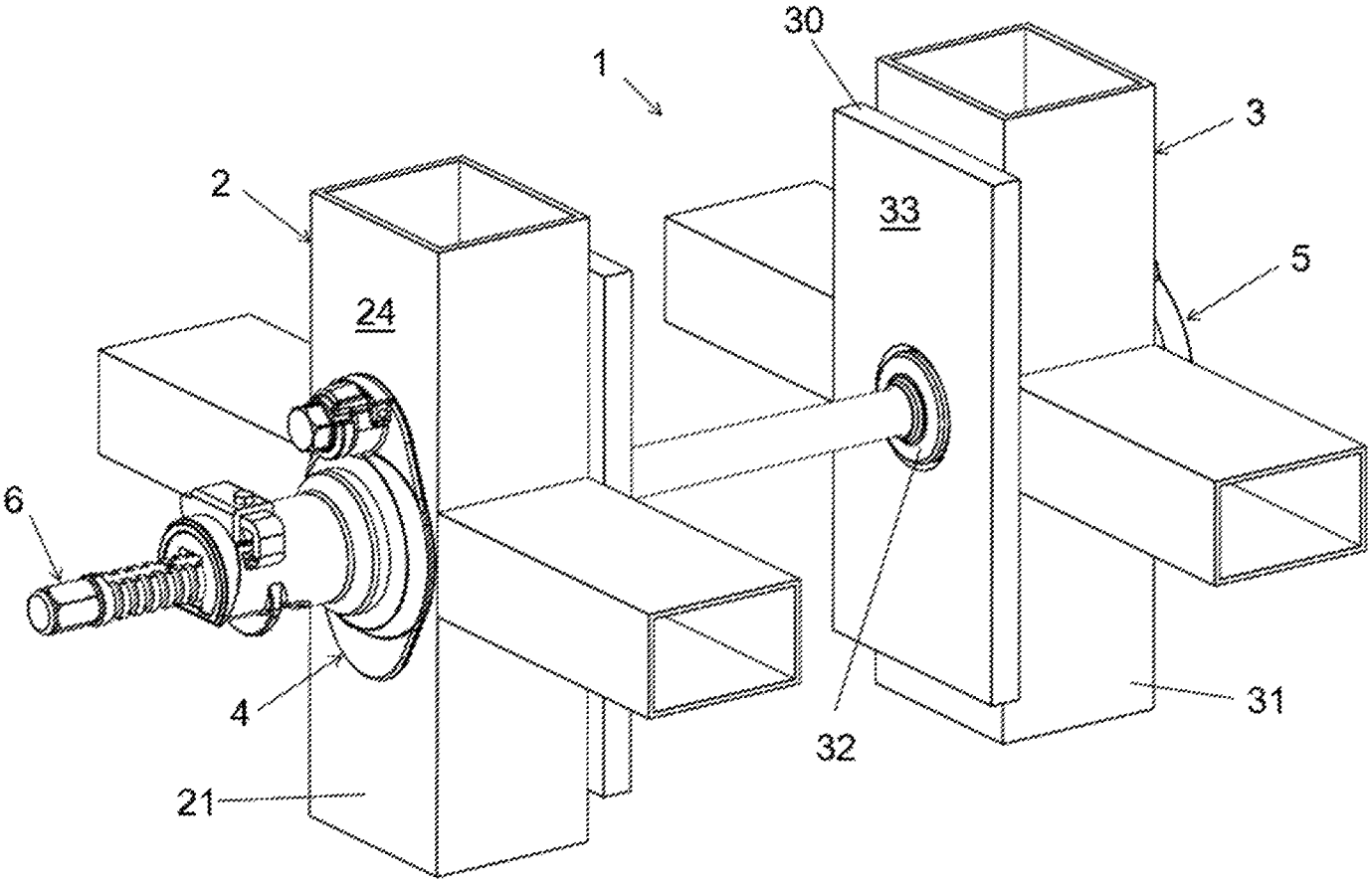
FIG. 1 shows a perspective view of a vertical formwork according to one embodiment.
Figure 2:
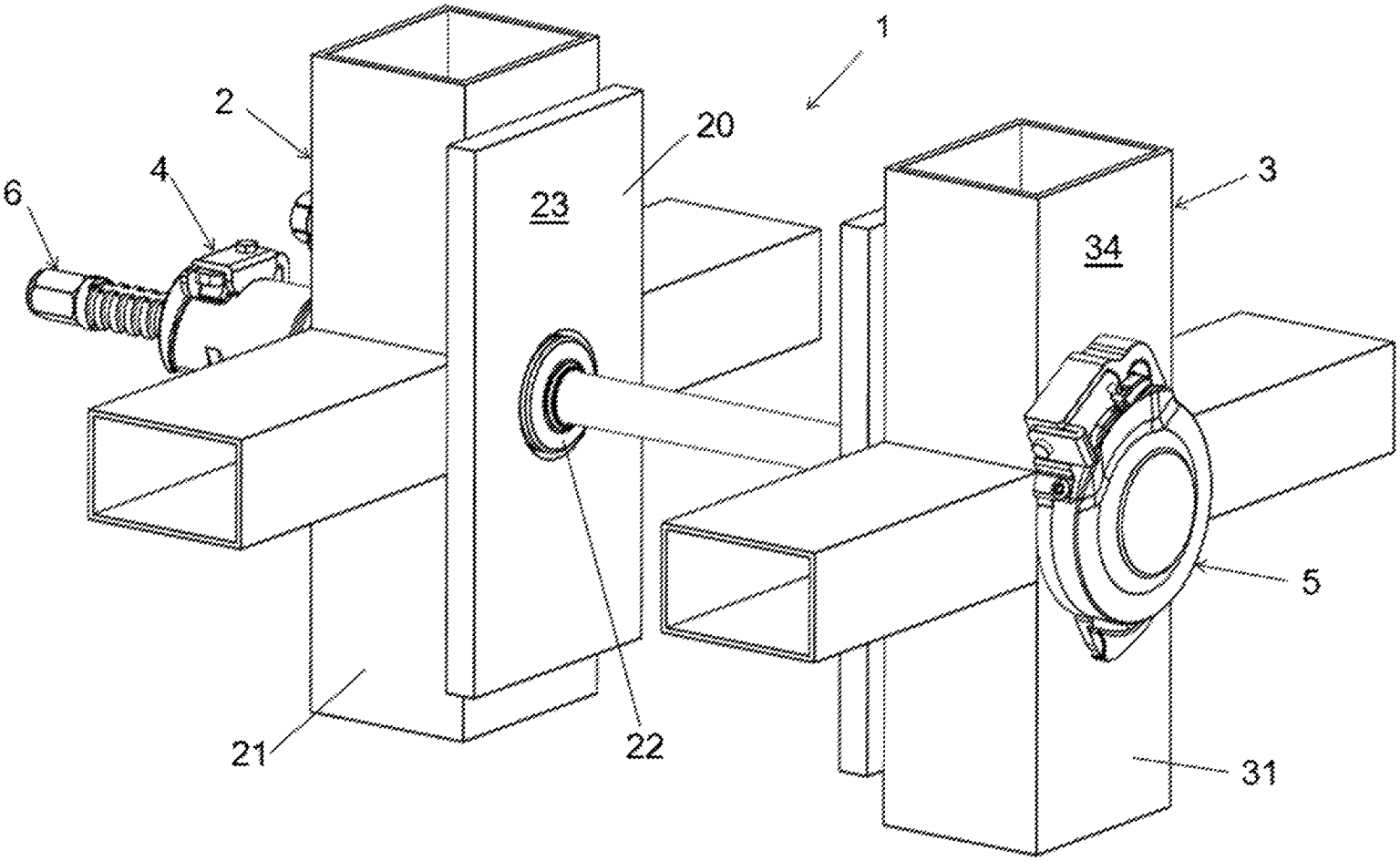
FIG. 2 shows a second perspective view of the vertical formwork of FIG. 1.
Figure 3:
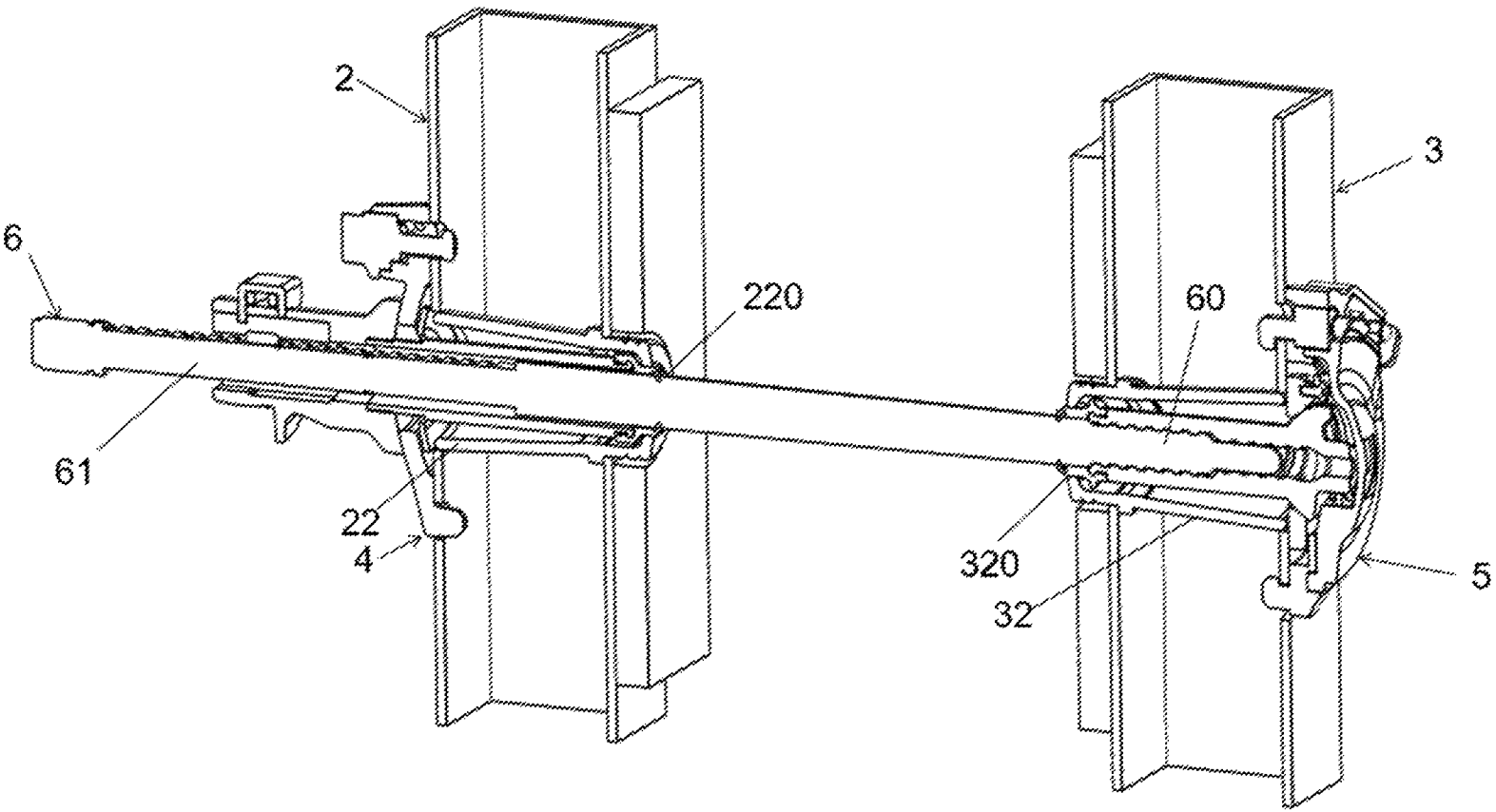
FIG. 3 shows a section view of the vertical formwork of FIG. 1.

According to one embodiment, a vertical formwork 1 is provided that comprises a front formwork panel 2 and a rear formwork panel 3 which are arranged facing one another. The vertical formwork 1 also comprises a front anchor 4 fixed to the front formwork panel 2, a rear anchor 5 fixed to the rear formwork panel 3, and a tie rod 6 with a threaded end 60 fixed to the rear anchor 5 and a first end 61 fixed to the front anchor 4.

The vertical formwork 1 of this embodiment is a vertical formwork 1 configured for being adjusted from one face, i.e., the tie rod 6 is fixed from one side of the vertical formwork 1. In vertical formworks 1 of this type, the rear anchor 5 is fixed to the rear formwork panel 3 before the front formwork panel 2 and the rear formwork panel 3 are arranged in the concreting position. Once the front formwork panel 2 and the rear formwork panel 3 are positioned in the concreting position, the operator is located in the front portion, fixing the threaded end 60 of the tie rod 6 to the rear anchor 5 and the first end 61 of the tie rod 6 to the front anchor 4 which is fixed to the front formwork panel 2. In the context of the invention, front portion will be considered the portion where the operator fixing the tie rod 6 is located. Therefore, the front formwork panel 2 is the formwork panel arranged on the side of the operator and the rear formwork panel 3 is the formwork panel facing said front panel 2. Similarly, the front anchor 4 is the anchor fixed to the front formwork panel 2, and the rear anchor 5 is the anchor fixed to the rear formwork panel 3. Furthermore, the inner face 23 and 33 of the formwork panel 2 and 3 is the face suitable for being arranged in contact with the concrete and the outer face 24 and 34 of the formwork panel 2 and 3 is the face opposite the inner face 23 and 33.

In this embodiment, the rear formwork panel 3 comprises a structure 31, a board 30 fixed to said structure 31, and a housing extending from the outer face 34 to the inner face 33 in which a bushing 32 is arranged, said bushing 32 going through said structure 31 and said board 30. The bushing 32 forms a housing in which part of the rear anchor 5 is housed. The bushing 32 has an entry opening which is arranged at the same level as the outer face 34 of the rear formwork panel 3 and an exit opening 320 which is arranged at the same level as the inner face 33 of the formwork panel, the diameter of the exit opening 320 being less than the diameter of the entry opening. Preferably, the board 30 is made of wood or plastic, and the structure 31 and the bushing 32 are made of metal.

In this embodiment, the configuration of the front formwork panel 2 is the same as the configuration of the rear formwork panel 4, and they can therefore be used interchangeably. For the sake of clarity, the formwork panels are only partially depicted in the drawings.

In other embodiments, depending on the dimensions of the formwork panel, each formwork panel can comprise a plurality of housings, a respective anchor and bushing being arranged in each of them, such that two facing formwork panels can be fixed to one another through a plurality of tie rods fixed to the anchors.

Figure 4:
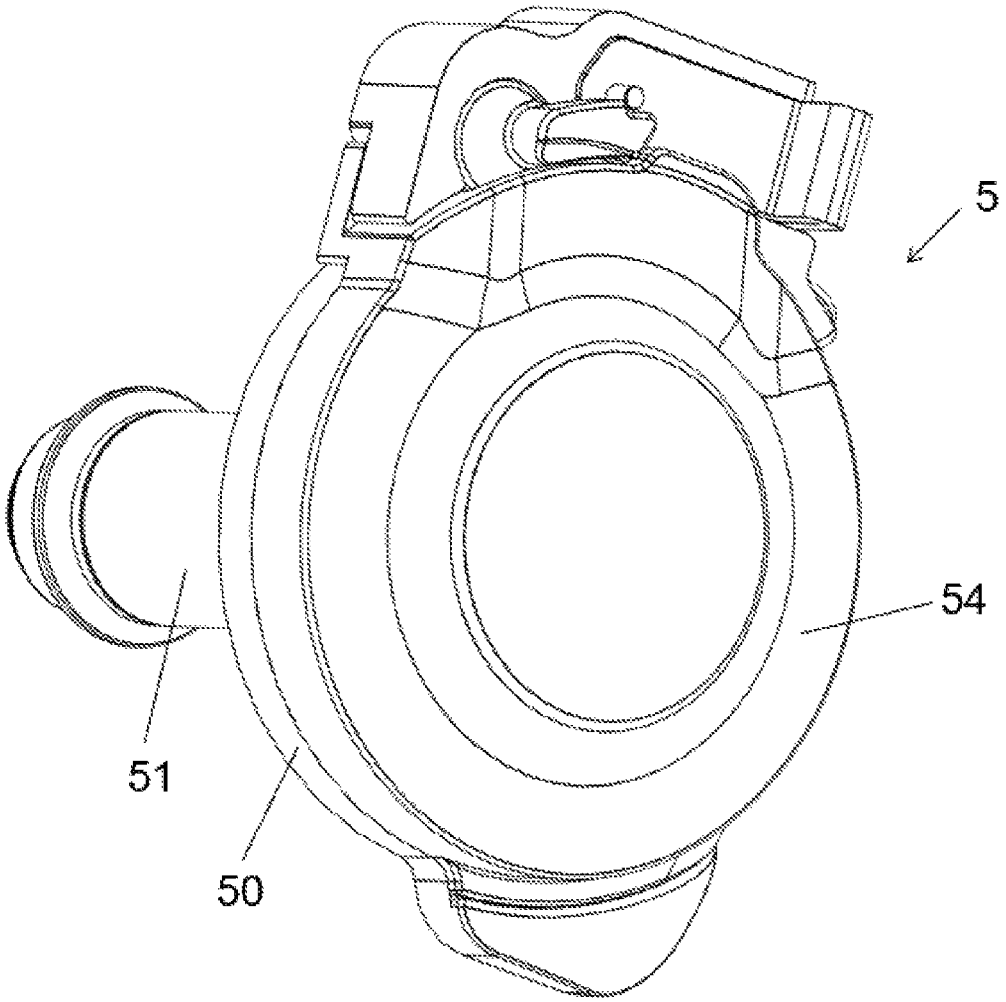
FIG. 4 shows a perspective view of the rear anchor of the vertical formwork of FIG. 1.
Figure 5:
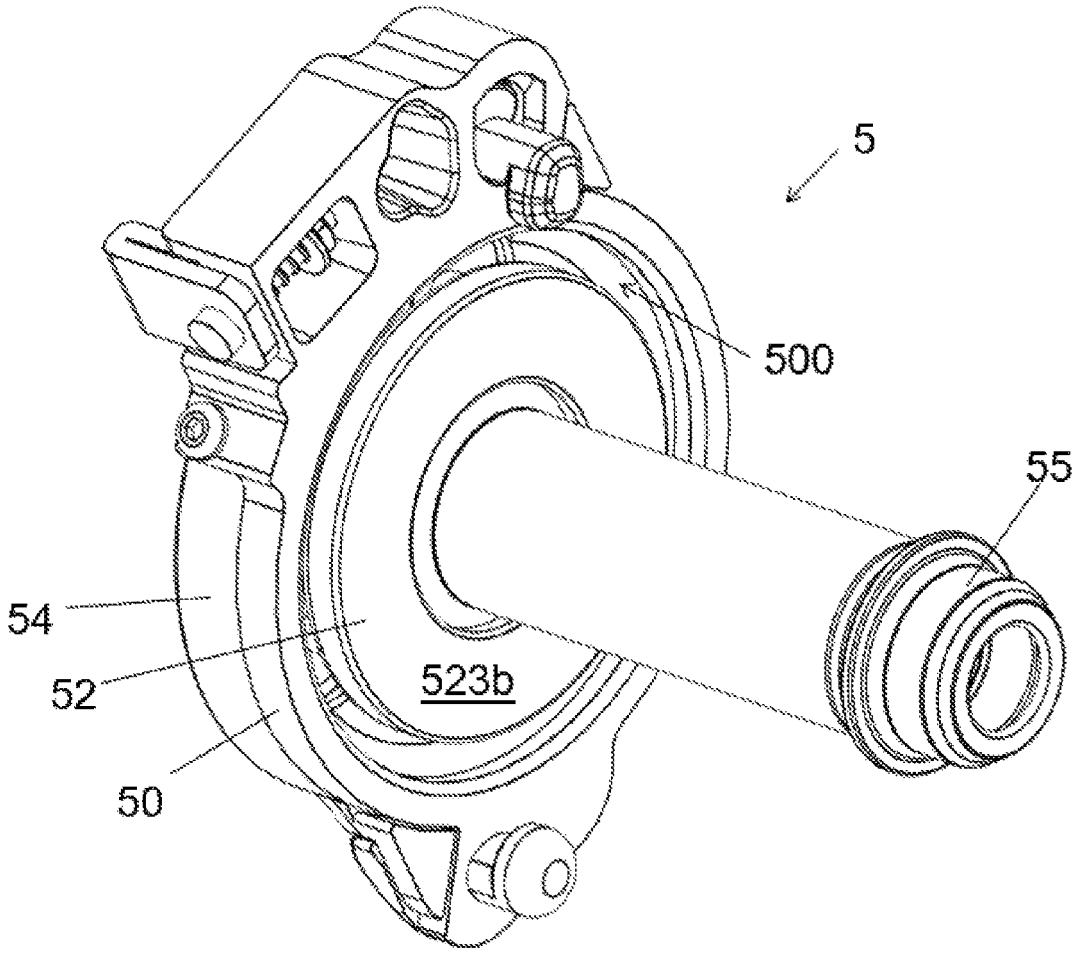
FIG. 5 shows a second perspective view of the rear anchor of FIG. 4.
Figure 6:
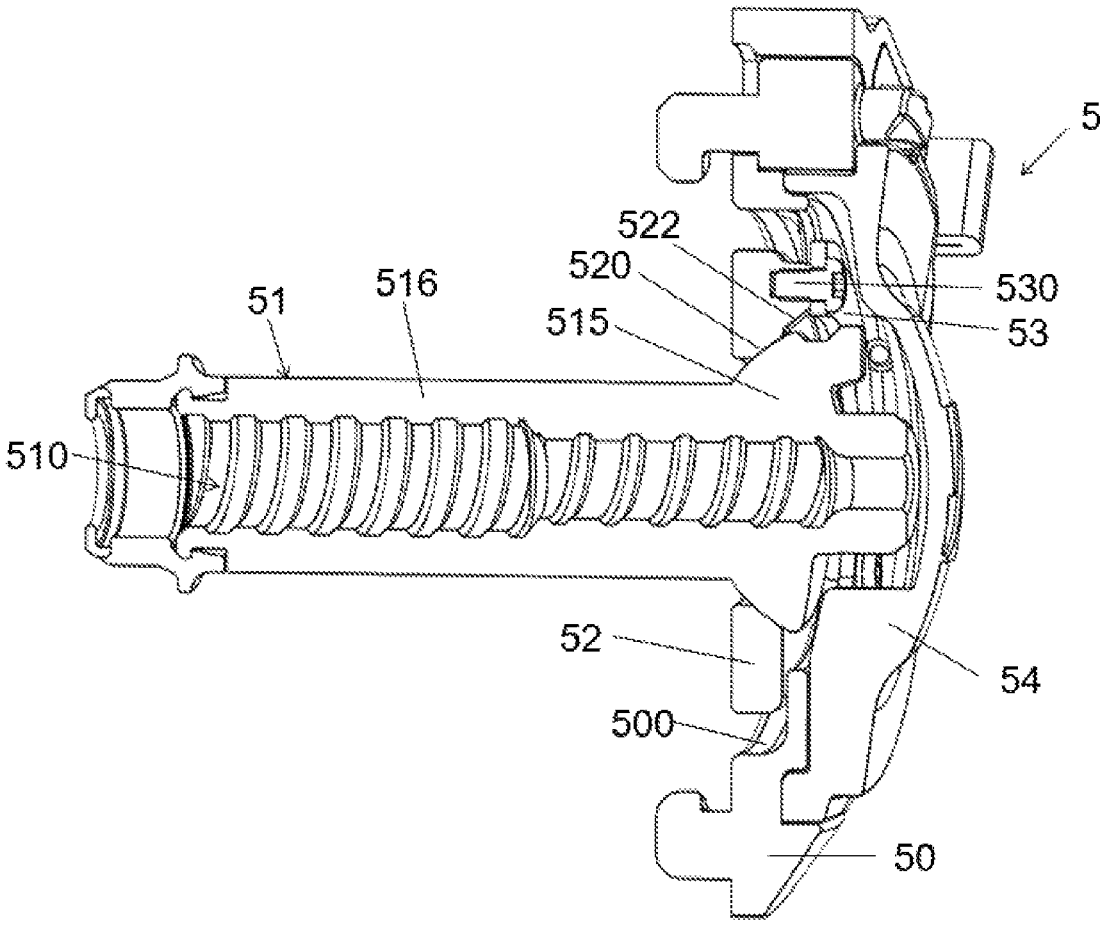
FIG. 6 shows a section view of the rear anchor of FIG. 4.
Figure 7:
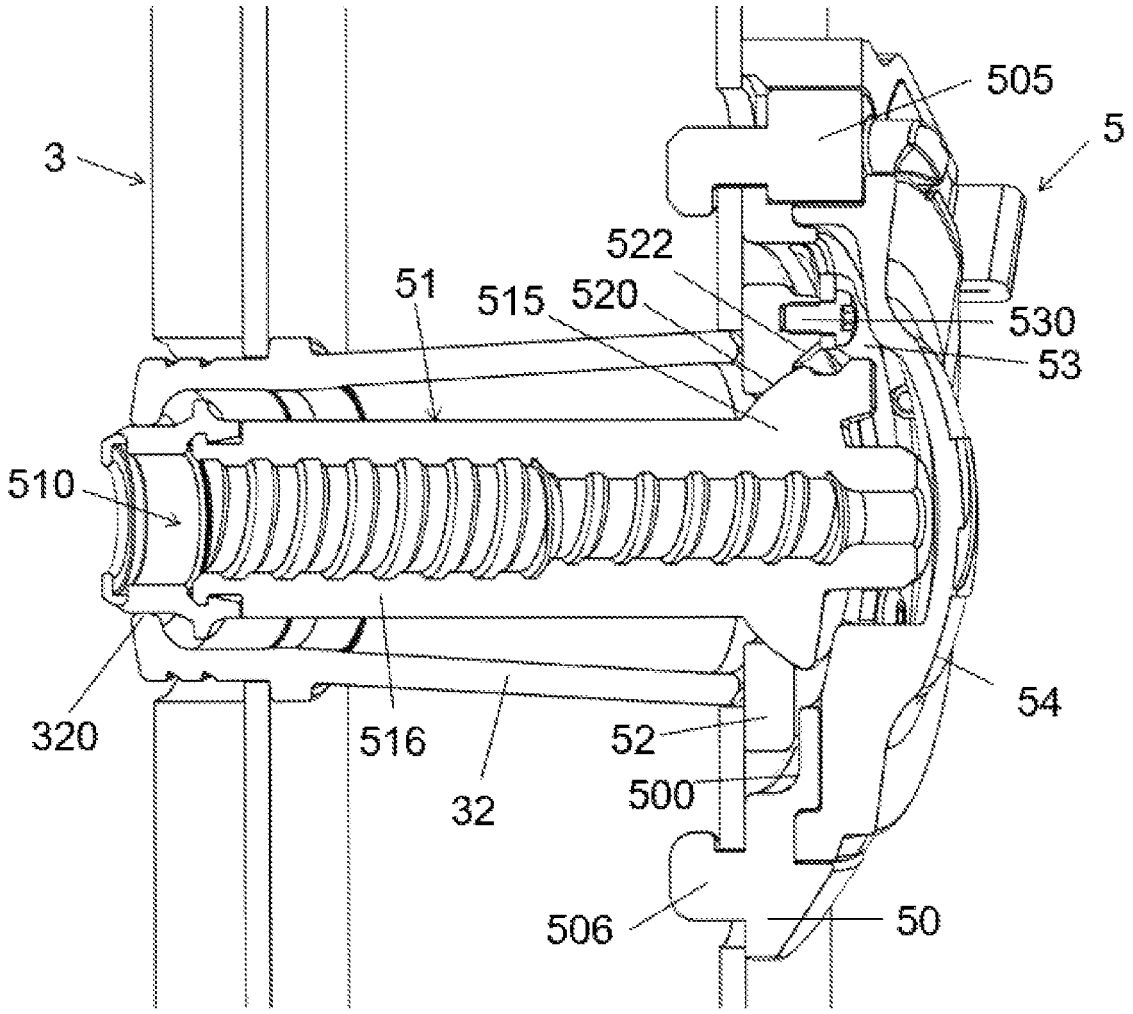
FIG. 7 shows a section view of the rear anchor of FIG. 4 when it is fixed to the rear formwork panel.
Figure 8:
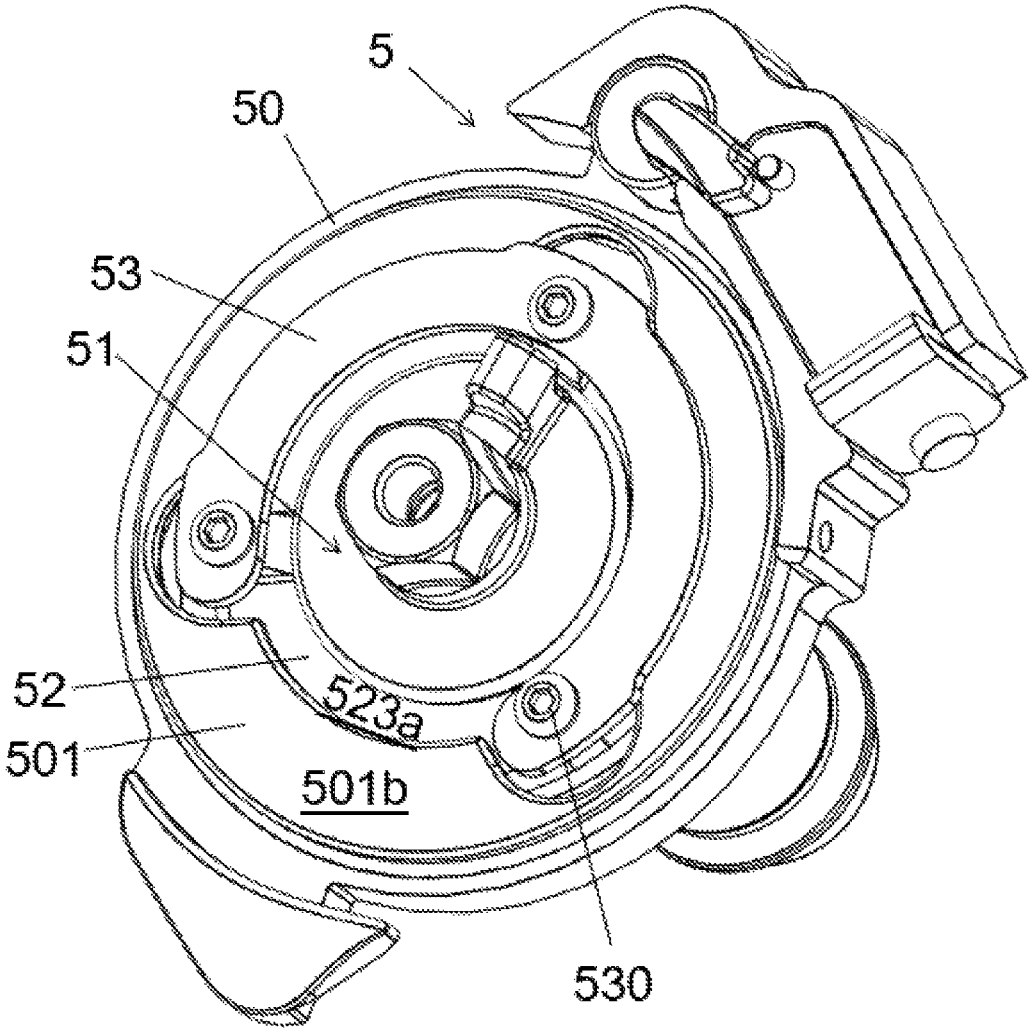
FIG. 8 shows a perspective view of the rear anchor of FIG. 4 without the cover.
Figure 9:
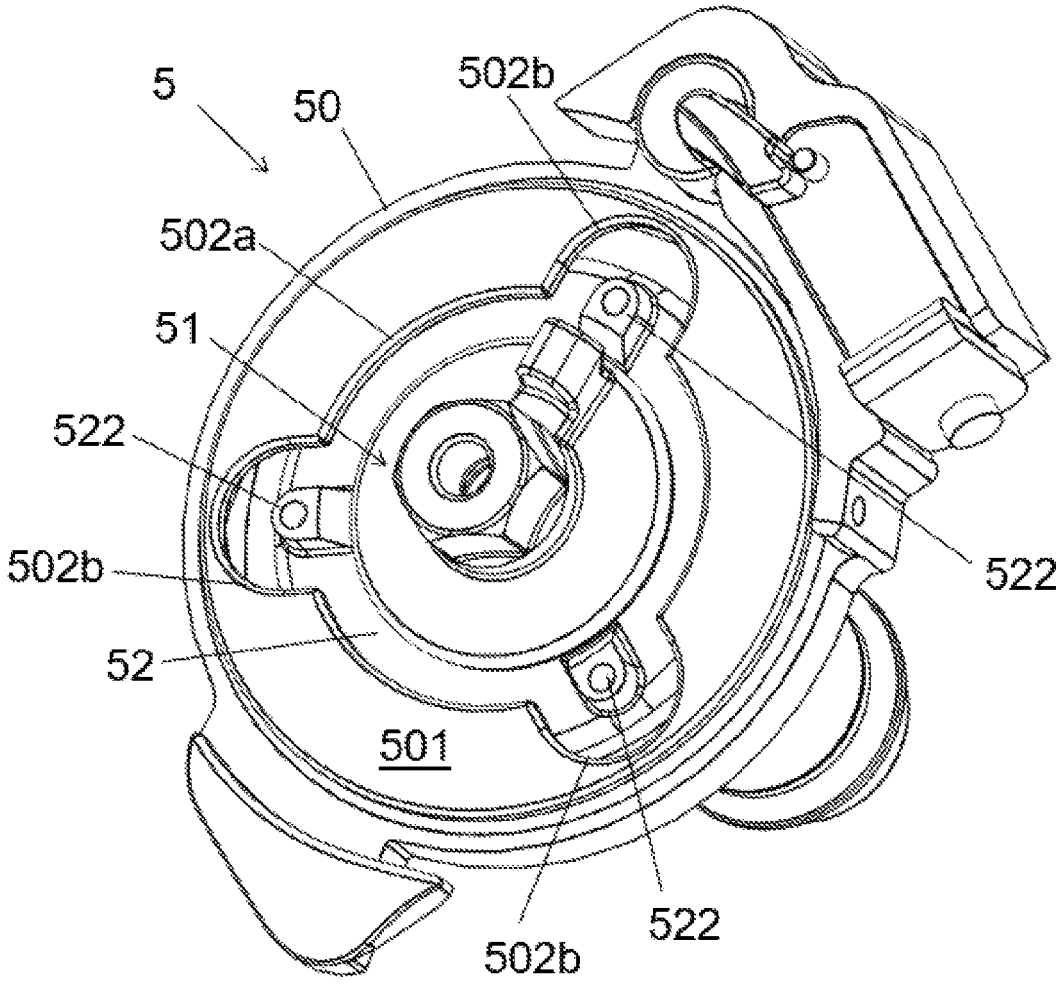
FIG. 9 shows a perspective view of the rear anchor of FIG. 4 without the cover and without the coupling plate.

As mentioned above, the vertical formwork 1 comprises a rear anchor 5 suitable for being fixed to the rear formwork panel 3. FIGS. 4 to 6 show the rear anchor 5 of this embodiment in detail.

The rear anchor 5 comprises a dome plate 52 comprising a spherical-shaped central section 520, said central section 520 comprising an opening 521. The rear anchor 5 also comprises a nut 51 with a threaded hole 510 configured for housing a threaded end 60 of a tie rod 6. The nut 51 comprises a spherical portion 515 which is arranged in the opening 521 of the dome plate 52. The spherical portion 515 of the nut 51 and the central section 520 of the dome plate 52 are coupled like a ball and socket joint, i.e., the nut can rotate about its shaft and furthermore adopt different inclinations with respect to the central section of the dome plate.

The rear anchor 5 also comprises a support plate 50 configured for being fixed to the rear formwork panel 3. The support plate 50 comprises a housing 500 in which the dome plate 52 is arranged, the dome plate 52 having freedom of radial movement with respect to the support plate 50 inside the housing 500.

The ball and socket joint-like coupling between the spherical portion 515 of the nut 51 and the central section 520 of the dome plate 52, and the radial movement of the dome plate 52 with respect to the support plate 50, allows orienting the nut 51 with respect to the rear formwork panel 3. Therefore, when the operator has to screw the threaded end 60 of a tie rod 6 into the threaded hole 510 of the nut 51, it can be done even though the exit opening 220 of the bushing 22 of the front formwork panel 2 and the exit opening 320 of the bushing 32 of the rear panel 3 are not perfectly aligned. The nut 51 can therefore be adapted to the inclination of the tie rod 6.

Figure 10:
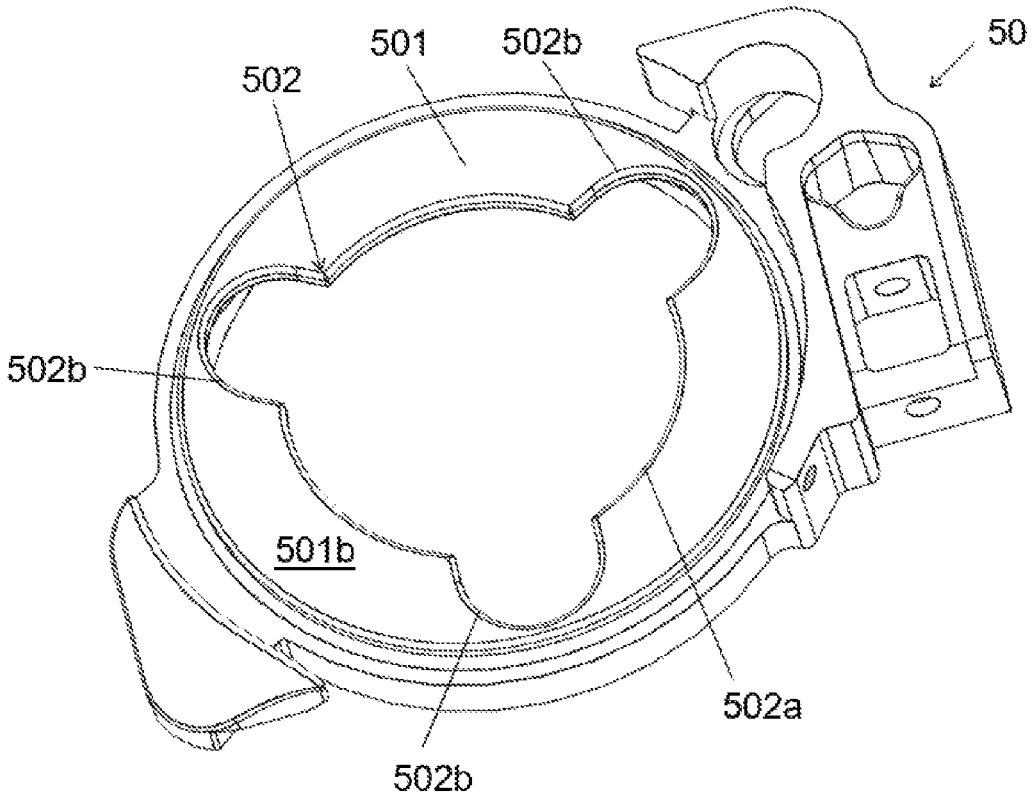
FIG. 10 shows a perspective view of the support plate of the rear anchor of FIG. 4.
Figure 11:
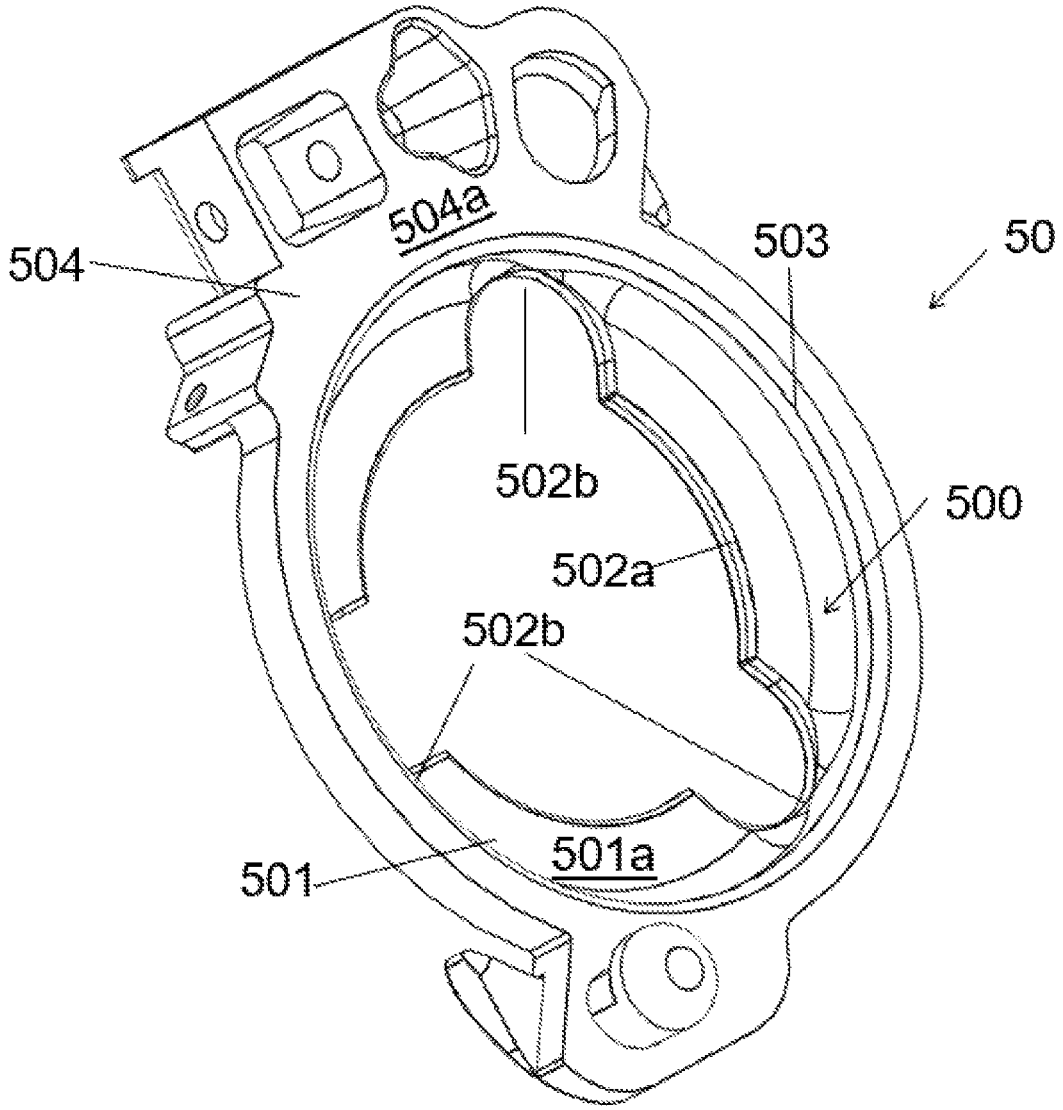
FIG. 11 shows a second perspective view of the support plate of FIG. 10.

The support plate 50 of this embodiment, shown in detail in FIGS. 10 and 11, comprises an outer wall 501 and a side wall 503 that prolongs perpendicularly from the perimeter of said outer wall 501. The outer wall 501 and the side wall 503 demarcate the housing 500 in which the dome plate 52 is arranged. The outer wall 501 comprises an opening 502.

In this embodiment, the rear anchor 5 also comprises coupling means for retaining the dome plate 52 inside the housing 500 of the support plate 50. The dome plate 52 thereby remains coupled to the support plate 50 even when the rear anchor 5 is not fixed to the rear formwork panel 3.

Figure 13:
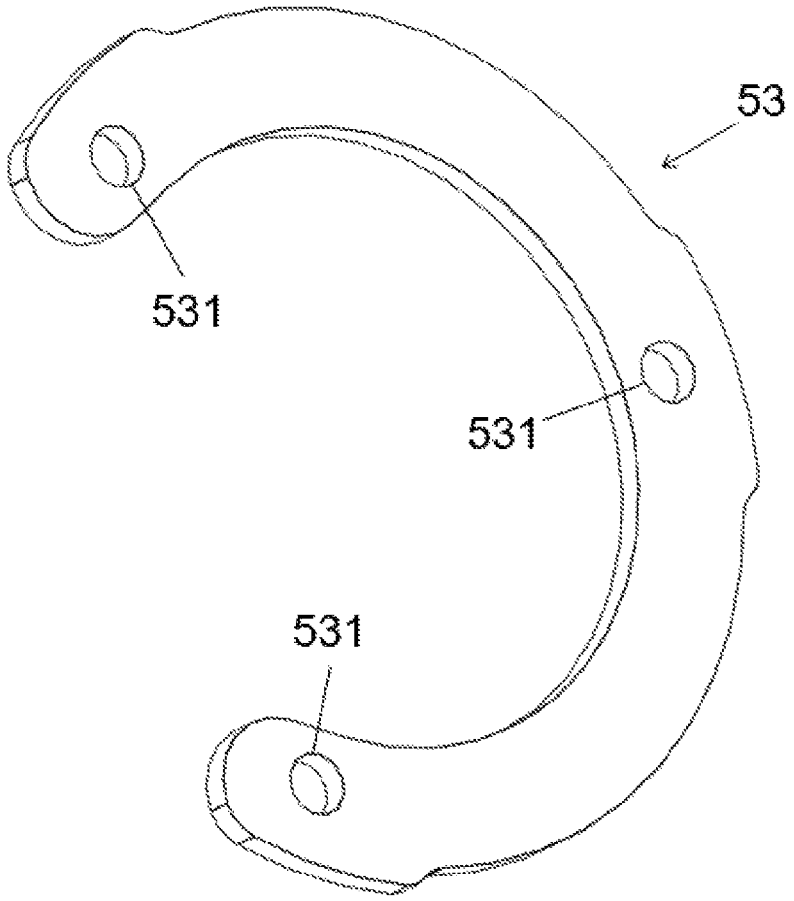
FIG. 13 shows a perspective view of the coupling plate of the rear anchor of FIG. 4.

In this embodiment, the coupling means comprise a coupling plate 53, shown in detail in FIG. 13. The coupling plate 53 is arranged outside the housing 500 of the support plate 50 and facing the outer wall 501 of said support plate 50.

In this embodiment, the coupling plate 53 is fixed to the dome plate 52 by means of a plurality of fixing elements 530 through the opening 502 of the outer wall 501, such that at least part of said coupling plate 53 is supported on the outer wall 501 in any of the positions of the dome plate 52 inside the housing 500.

In this embodiment, the opening 502 of the outer wall 501 comprises a central area **502*a* and further comprises a side area 502*b* associated with each fixing element 530, each fixing element 530 being movable within the respective side area 502*b*. As seen in FIG. 10, in this embodiment the central area 502*a* of the opening 502 is circular-shaped and the side areas 502*b*** are arch-shaped, particularly semioval-shaped.

In this embodiment, the coupling plate 53 is attached to the dome plate 52 by means of three fixing elements 530, said fixing elements preferably being equally spaced. Furthermore, in this embodiment the coupling plate 53 is C-shaped.

Figure 12:
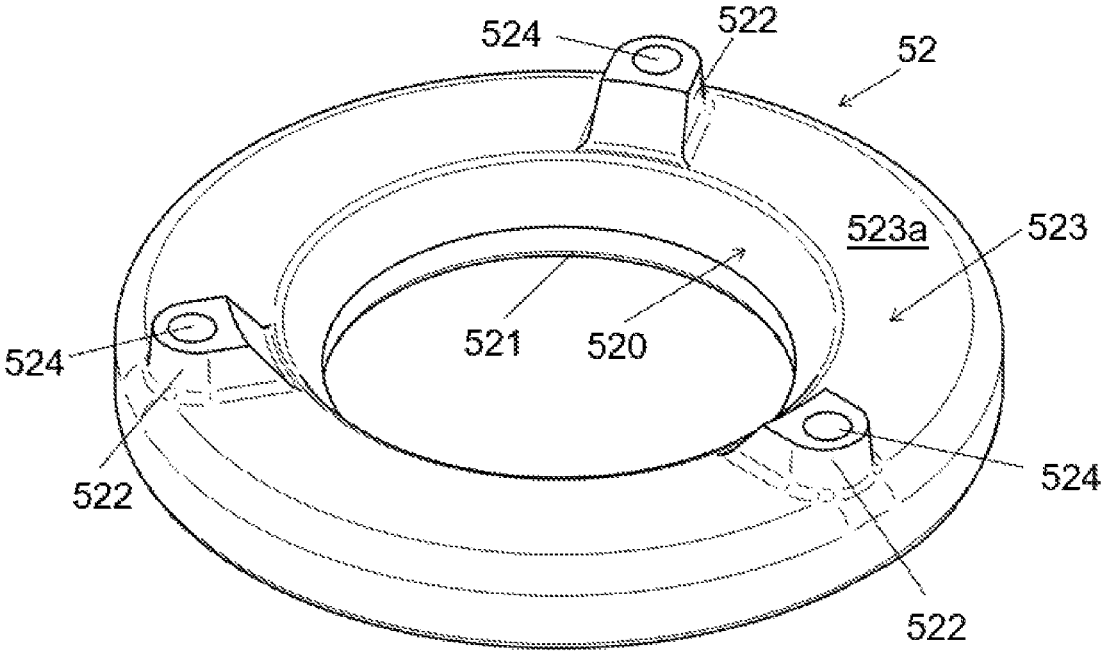
FIG. 12 shows a perspective view of the dome plate of the rear anchor of FIG. 4.

In this embodiment, the dome plate 52, shown in detail in FIG. 12, comprises one spacer 522 for each fixing element 530, each fixing element 530 being fixed to a respective spacer 522.

The dome plate 52 of this embodiment comprises a perimetral portion 523 around the central section 520. The perimetral portion comprises a front face **523*a* which is arranged opposite the inner face 501*a* of the outer wall 501 of the support plate 50. The spacers 522 project perpendicularly from the front face 523*a* of the dome plate. As discussed above, the coupling plate 53 is fixed to the dome plate 52 by means of three fixing elements 530**, and the coupling plate therefore has three spacers which are arranged at 120 degrees from one another.

In this embodiment, the upper face of the spacers 522 is supported against the coupling plate 53. The height of said spacers is greater than the thickness of the outer wall 501 of the support plate 50, such that part of the outer wall 501 of the support plate can be housed in the space existing between the coupling plate 53 and the dome plate 52.

In this embodiment, each spacer 522 comprises a threaded hole 524, the fixing elements 530 being screws going through a respective hole 531 of the coupling plate 53 and being screwed into a respective threaded hole 524 of the dome plate 52.

In this embodiment, the spacers 522 of the dome plate 52 and the side areas **502*b* of the opening 502 of the support plate 50 are sized and arranged such that it is assured that the dome plate 52 can be arranged in any position inside the housing 500 of the support plate 50, at least part of each spacer 522 in any of said position being housed within the respective side area 502***b* thereof.

Figure 15:
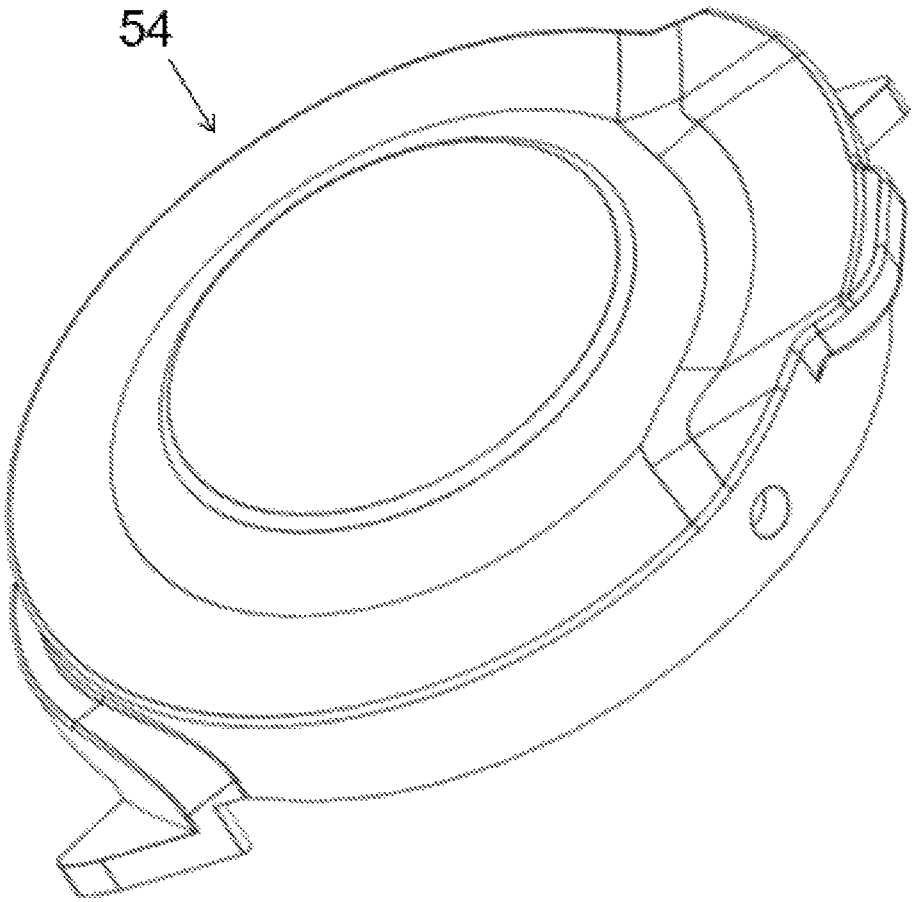
FIG. 15 shows a perspective view of the cover of the rear anchor of FIG. 4.
Figure 16:
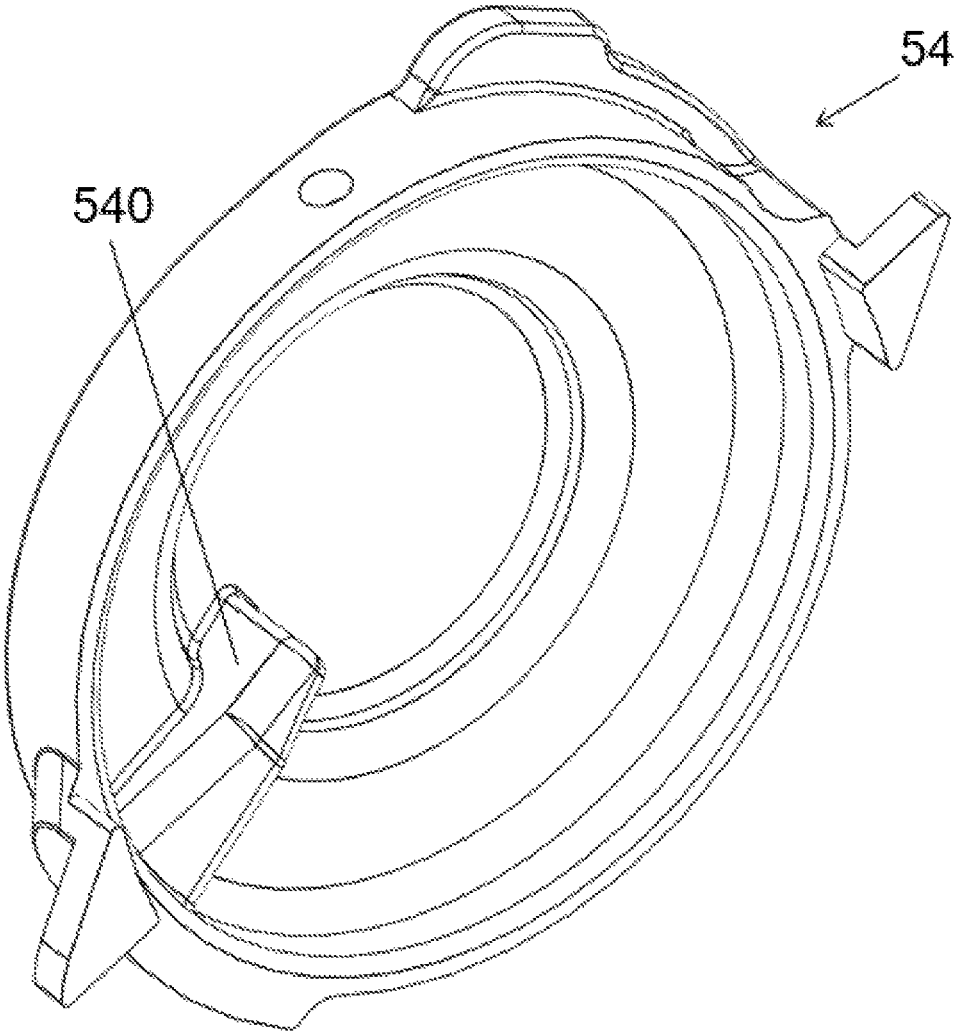
FIG. 16 shows a second perspective view of the cover of FIG. 15.

In this embodiment, the rear anchor 5 comprises a cover 54, shown in detail in FIGS. 15 and 16. The cover 54 is detachably fixed to the support plate 50, the cover 54 and the support plate 50 delimiting a housing in which the nut 51 is retained. Therefore, when the cover 54 is fixed to the support plate 50, the assembly formed by the dome plate 52, the coupling plate 53, the nut 51, in addition to the support plate 50 and cover 54, are coupled as a single part such that they are easier for operators to handle.

Furthermore, in this embodiment the cover 54 goes around the different components of the rear anchor 5 such that if concrete falls onto a rear anchor 5 when it is fixed in the rear formwork panel 3, the concrete will not come into contact with the nut 51, the outer wall 501 of the support plate 50, the dome plate 52 and the fixing plate 53.

Figure 14:
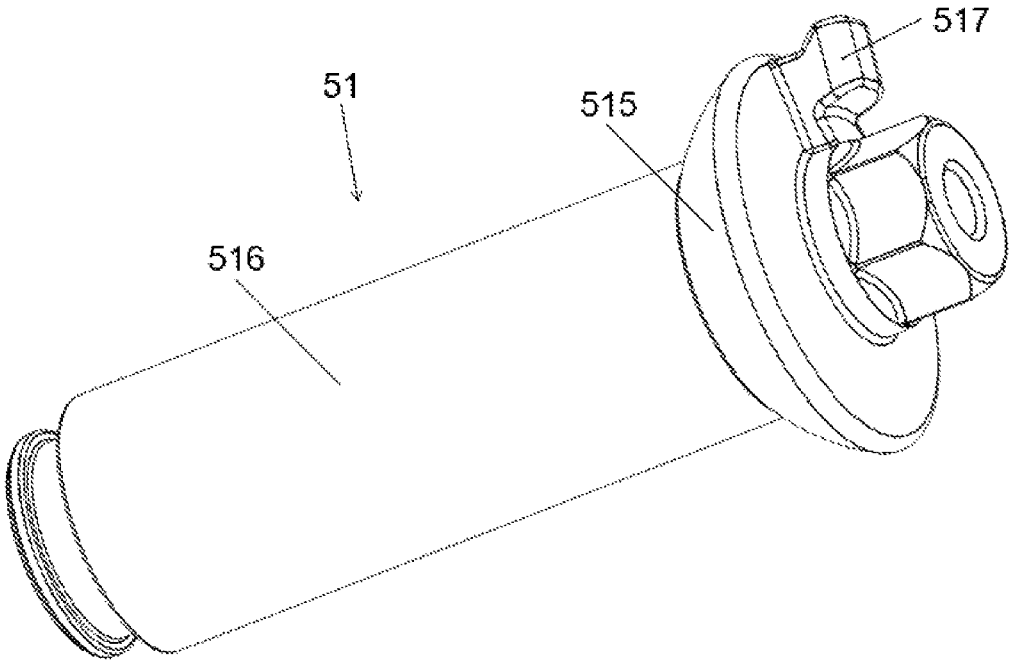
FIG. 14 shows a perspective view of the nut of the rear anchor of FIG. 4.

The nut 51 of this embodiment, shown in detail in FIG. 14, comprises a tubular portion 516, and the spherical portion 515 after a first end of said tubular portion 516. The second end of the tubular portion 516 is arranged in the proximity of the inner face 33 of the rear formwork panel 3 when the rear anchor 5 is fixed to the rear formwork panel 3. The tubular portion 516 of the nut is housed in the bushing 32 of the rear formwork panel 3.

In this embodiment, the nut 51 comprises a radial prolongation 517 projecting perpendicularly from the spherical portion 515 of said nut 51. Furthermore, the cover 54 comprises a rotation stop 540 cooperating with said radial prolongation 517 of the nut 51. In this embodiment, the cover 54 and the rotation stop 540 form a single part.

The rotation stop 540 of the cover 54 cooperates with the radial prolongation 517 of the nut 51, preventing the nut 51 from endlessly rotating when the threaded end 61 of the tie rod 6 is being screwed in from the front portion. However, the fact that the rotation stop 540 can be separated from the radial prolongation 517 of the nut 51 by detaching the cover 54 of the support plate 50 is quite useful when concrete leaks into the gap formed between the front anchor 4 and the bushing 22 of the front formwork panel 2. Separating the rotation stop 540 from the radial prolongation 517 of the nut 51 allows slightly unscrewing the threaded end 60 of the tie rod 6 by rotating the nut 51 in the direction that would be limited by the rotation stop 540 to then strike the nut 51, and thereby letting go of the front anchor 4. Furthermore, with the configuration of the rear anchor 5 of this embodiment, this operation can be done in a simple manner since when the cover 54 is detached from the support plate 50, the nut 51 is not coupled to any other part of the rear anchor 5 and can therefore be unscrewed from the threaded end 60 of the tie rod 6 without any problems.

In other possible embodiments, the rotation stop could be detachably coupled to the support plate 50.

In this embodiment, the rear anchor 5 comprises a sealing element 55 which is arranged in the second end of the nut 51, said sealing element 55 sealing both the rear anchor 5 with respect to the rear formwork panel 3, and the rear anchor 5 with respect to the tie rod 6 housed in the threaded hole of the nut.

In this embodiment, the support plate 50 comprises a support wall 504 with a fixing system configured for fixing the rear anchor 5 to the rear formwork panel 3. The fixing system comprises a fixing key 505 which is arranged in a housing of the support wall 504 and a pin 506 projecting perpendicularly with respect to said support wall 504. In this embodiment, when the cover 54 is fixed to the support plate 50, the actual cover 54 prevents the fixing key 505 from coming out of the housing of the support wall 504 of the support plate 50 in which it is housed, such that the cover 54 makes that the fixing key 506 cannot be detached from the rest of the rear anchor 5.

In this embodiment, when the rear anchor 5 is arranged fixed to the rear formwork panel 3, the tubular portion 516 of the nut 51 is housed in the bushing 32 of the rear formwork panel 3, whereas the rear face 523*b* of the perimetral portion 523 of the dome plate 52 and the rear face 504*a* of the support wall 504 are supported against the outer face 33 of the rear formwork panel 3.

The following clauses represent example embodiments.

Clause 1. A rear anchor for a vertical formwork, comprising

- a dome plate (52) comprising a spherical-shaped central section (520) comprising an opening (521), and
- a nut (51) with a threaded hole (510) configured for housing a threaded end (60) of a tie rod (6), the nut (51) comprising a spherical portion (515) which is arranged in the opening (521) of the dome plate (52), the spherical portion (515) of the nut (51) and the central section (520) of the dome plate (52) being coupled like a ball and socket joint, and
- a support plate (50) configured for being fixed to a rear formwork panel (3), said support plate (50) comprising a housing (500) in which the dome plate (52) is arranged, with freedom of radial movement with respect to the support plate (50) inside the housing (500).

Clause 2: The rear anchor according to clause 1, comprising coupling means for retaining the dome plate (52) inside the housing (500) of the support plate (50).

Clause 3: The rear anchor according to clause 2, wherein the support plate (50) comprises an outer wall (501) demarcating the housing (500), said outer wall (501) comprising an opening (502), the coupling means comprising a coupling plate (53) arranged outside the housing (500) of the support plate (50) and facing the outer wall (501) of said support plate (50), said coupling plate (53) being fixed to the dome plate (52) by means of a plurality of fixing elements (530) through the opening (502) of the outer wall (501), at least part of said coupling plate (53) being supported on the outer wall (501) in any of the positions of the dome plate (52) inside the housing (500).

Clause 4: The rear anchor according to clause 3, wherein the opening (502) of the outer wall (501) comprises a central area (502*a*) and further comprises a side area (502*b*) associated with each fixing element (530), each fixing element (530) being movable within the respective side area (502*b*).

Clause 5: The rear anchor according to clause 4, wherein the central area (502*a*) of the opening (502) of the outer wall (501) of the support plate (50) is circular-shaped and the side areas (502*b*) are arch-shaped, preferably semioval-shaped.

Clause 6: The rear anchor according to clause 5, wherein the coupling plate (53) is attached to the dome plate (52) by means of three fixing elements (530), said fixing elements preferably being equally spaced.

Clause 7: The rear anchor according to any of clauses 3 to 6, wherein the coupling plate (53) is C-shaped.

Clause 8: The rear anchor according to any of clauses 3 to 7, wherein the dome plate (52) comprises one spacer (522) for each fixing element (530), each fixing element (530) being fixed to a respective spacer (522).

Clause 9: The rear anchor according to any of the preceding clauses, comprising a cover (54) detachably fixed to the support plate (50), the cover (54) and the support plate (50) delimiting a housing in which the nut (51) is retained.

Clause 10: The rear anchor according to clause 9, wherein the nut (51) comprises a radial prolongation (517) cooperating with a rotation stop (540) detachably coupled to the support plate (50).

Clause 11: The rear anchor according to clause 10, wherein the cover (54) comprises the rotation stop (540), the cover (54) and the rotation stop (540) preferably forming a single part.

Clause 12: A vertical formwork comprising:

one front formwork panel (2) and one rear formwork panel (3) which are arranged facing one another, one front anchor (4) fixed to the front formwork panel (2), one rear anchor (5) according to any of the preceding clauses fixed to the rear formwork panel (3), and one tie rod (6) fixed to the front anchor (4) and to the rear anchor (5).

What is claimed is:

1. A rear anchor assembly for a vertical formwork comprising:

a dome plate including a spherical-shaped section and a central opening demarcated by the spherical-shaped section, a nut with a threaded hole configured for housing a threaded end of a tie rod, the nut including a spherical portion that is arranged in the central opening of the dome plate, the spherical portion of the nut and the spherical-shaped section of the dome plate being coupled like a ball and socket joint, and a support plate configured for being fixed to a rear formwork panel, the support plate including a housing in which at least a portion of the dome plate is arranged, a radial void existing between the housing of the support plate and the dome plate so that the dome plate has freedom of radial movement with respect to the support plate inside the housing so that the dome plate can assume different first and second radial positions inside the housing, the dome plate having a same shape when in the first and second radial positions.

2. The rear anchor assembly according to claim 1, wherein the dome plate is retained inside the housing of the support plate by one or more fixing elements.

3. The rear anchor assembly according to claim 1, wherein the support plate includes an outer wall that forms at least a part of the housing, the outer wall demarcating an opening, the rear anchor assembly further comprising a coupling plate arranged outside the housing of the support plate and facing the outer wall of the support plate, the coupling plate being fixed to the dome plate by the one or more fixing elements extending through the opening demarcated by the outer wall of the support plate, at least a part of the coupling plate being supported on the outer wall when the dome plate is in any of the different positions inside the housing of the support plate.

4. The rear anchor assembly according to claim 3, comprising a plurality of fixing elements, wherein the opening of the support plate includes a central area and a plurality of side areas respectively associated with the plurality of fixing elements, each of the fixing being movable within a respective side area.

5. The rear anchor assembly according to claim 4, wherein the central area of the opening of the support plate is circular-shaped and each of the plurality of side areas is arch-shaped.

6. The rear anchor assembly according to claim 4, wherein the central area of the opening of the support plate is circular-shaped and each of the plurality of side areas is semioval-shaped.

7. The rear anchor assembly according to claim 5, wherein the coupling plate is attached to the dome plate by means of three fixing elements.

8. The rear anchor assembly according to claim 7, wherein the three fixing elements are spaced equidistantly from one another.

9. The rear anchor assembly according to claim 3, wherein the coupling plate is C-shaped.

10. The rear anchor assembly according to claim 3, wherein the dome plate comprises a spacer for each of the one or more fixing element, each of the one or more fixing element being fixed to a respective spacer.

11. The rear anchor assembly according to claim 1, further comprising a cover detachably fixed to the support plate.

12. The rear anchor assembly according to claim 11, wherein the nut includes a radial prolongation configured to cooperate with a rotation stop detachably coupled to the support plate to prevent a rotation of the nut.

13. The rear anchor assembly according to claim 12, wherein the rotation stop is a part of the cover.

14. The rear anchor assembly according to claim 13, wherein the cover and the rotation stop are a single part.

15. A vertical formwork comprising:

a front formwork panel;

a rear formwork panel arranged facing the front formwork panel, a front anchor assembly fixed to the front formwork panel, a rear anchor assembly fixed to the rear formwork panel, a tie rod having a first end fixed to the front anchor, the rear anchor assembly comprising:

a dome plate including a spherical-shaped section and a central opening demarcated by the spherical-shaped section, a nut with a threaded hole that houses a threaded second end of the tie rod, the nut including a spherical portion that is arranged in the central opening of the dome plate, the spherical portion of the nut and the spherical-shaped section of the dome plate being coupled like a ball and socket joint, and a support plate fixed to the rear formwork panel, the support plate including a housing in which at least a portion of the dome plate is arranged a support plate configured for being fixed to a rear formwork panel, the support plate including a housing in which at least a portion of the dome plate is arranged, a radial void existing between the housing of the support plate and the dome plate so that the dome plate has freedom of radial movement with respect to the support plate inside the housing so that the dome plate can assume different first and second radial positions inside the housing, the dome plate having a same shape when in the first and second radial positions freedom of radial movement inside the housing of the support plate so that the dome plate can assume different first and second radial positions inside the housing, the dome plate having a same shape when in the first and second radial positions.

16. The rear anchor assembly according to claim 15, wherein the dome plate is retained inside the housing of the support plate by one or more fixing elements.

17. The rear anchor assembly according to claim 15, wherein the support plate includes an outer wall that forms at least a part of the housing, the outer wall demarcating an opening, the rear anchor assembly further comprising a coupling plate arranged outside the housing of the support plate and facing the outer wall of the support plate, the coupling plate being fixed to the dome plate by the one or more fixing elements extending through the opening demarcated by the outer wall of the support plate, at least a part of the coupling plate being supported on the outer wall when the dome plate is in any of the different positions inside the housing of the support plate.

18. The rear anchor assembly according to claim 17, comprising a plurality of fixing elements, wherein the opening of the support plate includes a central area and a plurality of side areas respectively associated with the plurality of fixing elements, each of the fixing elements being movable within a respective side area.

19. The rear anchor assembly according to claim 18, wherein the central area of the opening of the support plate is circular-shaped and each of the plurality of side areas is arch-shaped.

20. The rear anchor assembly according to claim 18, wherein the central area of the opening of the support plate is circular-shaped and each of the plurality of side areas is semioval-shaped.

* * * * *